United States Patent [19]

Wolsey

[11] Patent Number: 4,471,543

[45] Date of Patent: Sep. 18, 1984

[54] TENSION STRETCHER FOR ARTIST'S CANVAS

[76] Inventor: Clarence K. Wolsey, 441 Fairview, #3, Arcadia, Calif. 91006

[21] Appl. No.: 429,537

[22] Filed: Sep. 30, 1982

[51] Int. Cl.[3] ..... D06C 3/08

[52] U.S. Cl. ..... 38/102.91; 160/378; 269/54.1

[58] Field of Search ..... 69/19.1; 160/378, 380; 38/102, 102.1, 102.91; 101/127.1; 269/53, 54, 54.1

[56] References Cited

U.S. PATENT DOCUMENTS

| | | | |
|---|---|---|---|
| 142,735 | 9/1873 | Scherpe | 160/380 |
| 1,762,205 | 6/1930 | Verpillier | 38/102.1 X |
| 1,939,841 | 12/1933 | Briggs | 38/102 |
| 3,950,869 | 4/1976 | Samarin | 160/378 X |
| 4,317,302 | 3/1982 | Timphony et al. | 38/102 |

FOREIGN PATENT DOCUMENTS

| | | | |
|---|---|---|---|
| 189653 | 1/1907 | Fed. Rep. of Germany | 38/102 |

*Primary Examiner*—Werner H. Schroeder
*Assistant Examiner*—Andrew M. Falik
*Attorney, Agent, or Firm*—Boniard I. Brown

[57] ABSTRACT

An apparatus by which artist's canvas can be uniformly stretched on a frame. A first edge flap of the canvas is stapled to an edge of the frame at enough locations to withstand a predetermined tension without tearing. Thereafter, the frame is stood vertically on its opposite edge with a second flap of canvas extending beyond the edge of the frame into engagement with a plurality of pins of a predetermined diameter, which pass therethrough at predetermined intervals. The pins are located at an edge of a flat, horizontal surface of the apparatus but at a predetermined distance below the surface. The frame thereafter is rotated 90° downwardly tearing the canvas about the pins so that a predetermined tension in the canvas is established which depends upon the gauge of the canvas, the diameter of the pins and the distance between pin centers. The second edge is then stapled at enough points to prevent further tearing. Thereafter, an adjacent third edge of the canvas is stretched like the second but starting with the frame at about 45° to the surface and is stapled to the frame. The fourth canvas edge is engaged with the pins with the frame in a vertical position, and the frame is rotated 90° downwardly to a horizontal position tearing the canvas and establishing the predetermined stress in the other direction. The fourth edge is stapled to complete the operation.

6 Claims, 10 Drawing Figures

FIG. 1.
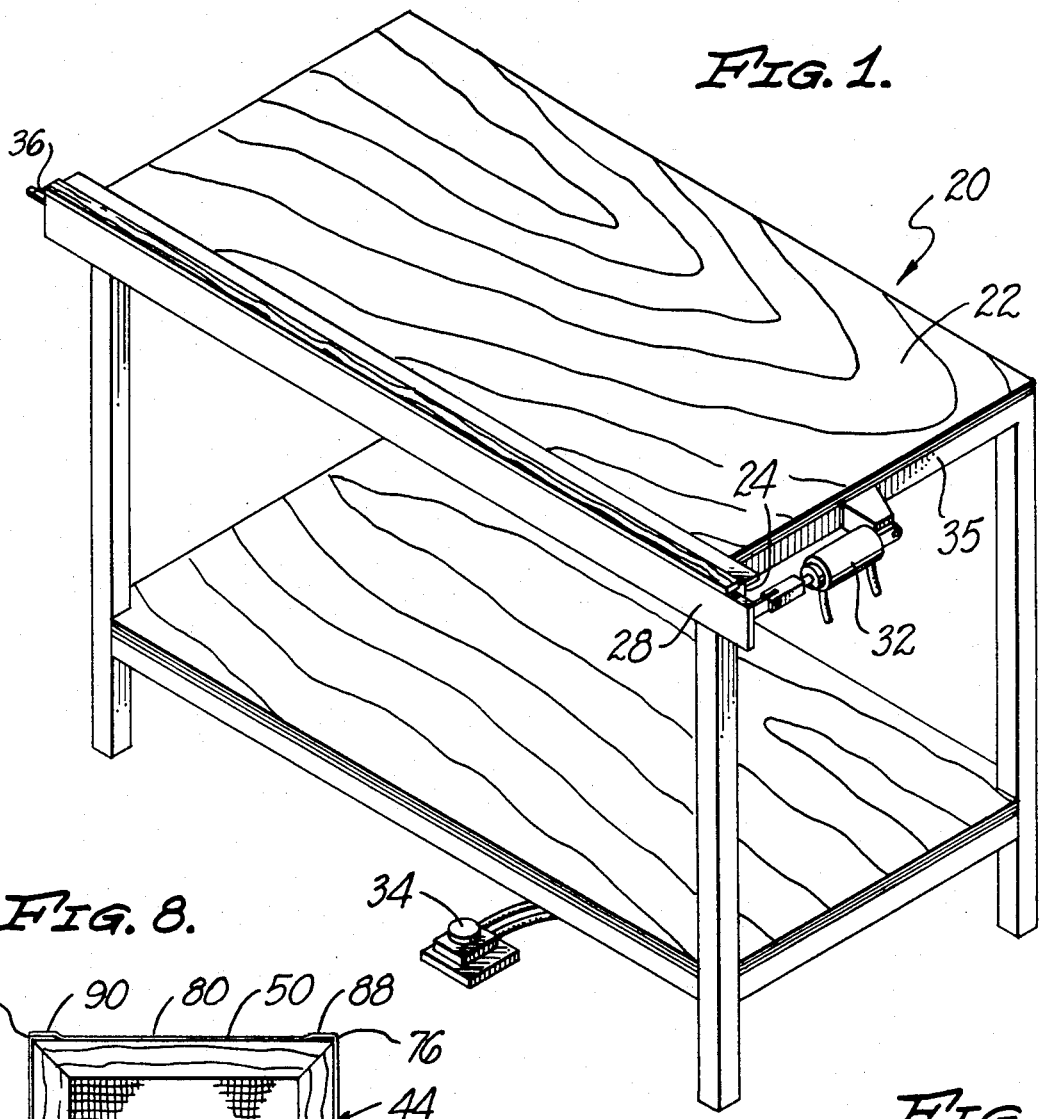
FIG. 8.
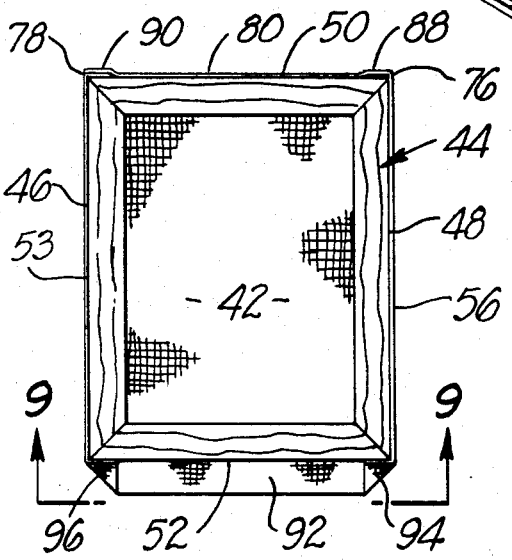
FIG. 3.
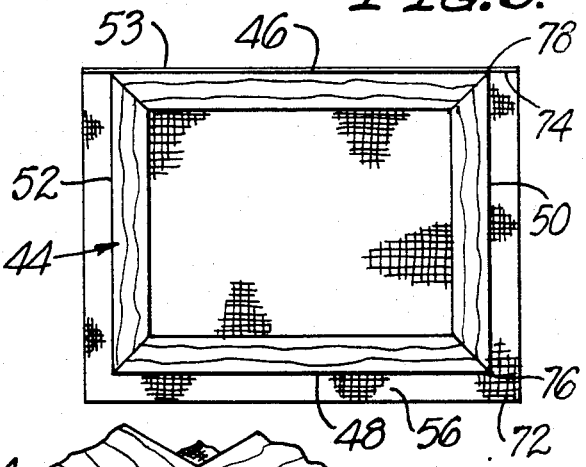
FIG. 9.
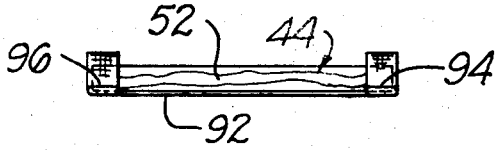
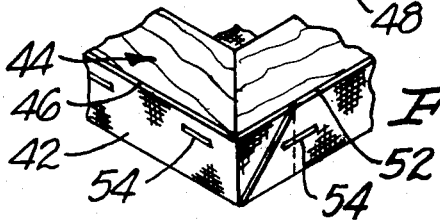
FIG. 10.

TENSION STRETCHER FOR ARTIST'S CANVAS

BACKGROUND OF THE INVENTION

When an artist wishes to paint on canvas, usually the canvas is stretched on a supporting frame structure comprised of a generally rectangular framework having four wooden side members. If the canvas is not stretched sufficiently or evenly along all four sides, waves or ripples are created in the canvas which make it unsuitable for use by the artist.

Various types of mounting and stretching devices exist which are used to tension canvas mounted on a frame. However, these devices, especially if they are adaptable to canvas of different weights having different stretching requirements, are expensive, often complicated to use and overly complex. Usually, they include some sort of clamping device for grabbing a free edge of the canvas and then spring or biasing means which are brought into play on the canvas which rely on the expertise of the user or a recalibration for every canvas weight and frame size. A typical prior art canvas stretching device is shown in U.S. Pat. No. 4,180,246.

SUMMARY OF THE INVENTION

The present invention is an apparatus and method for stretching and mounting canvas and other like materials on a frame to produce a product such as is typically used by artists. The apparatus includes a generally flat table with a hinged jaw mounted along one edge thereof which extends just above the upper surface thereof. The jaw includes a plurality of pointed pins of specifically chosen diameter, positioned at predetermined locations therealong a specific distance apart. An edge of the canvas to be stretched opposite an edge already fastened to the frame is inserted between the jaw and the edge of the table adjacent thereto with the frame vertical. The jaw is closed to push the pins through the canvas. Therefore, the canvas is mechanically retained by the pins rather than frictionally retained by the jaw which is common in the prior art. This pin engagement occurs with the frame and canvas generally at right angles to the pins. Thereafter, the frame is rotated 90° downwardly onto the tabletop while the canvas tears about the pins. The resistance of canvas to tearing generally is proportional to its gauge and the desired stress to be applied to stretch the canvas so that no adjustments are needed for a wide range of canvas gauges. Since wider canvas is engaged by more pins, no adjustments are needed for various frame sizes either. Thereafter, the edge of the jaw, which is slightly higher than the tabletop, is used as a guide for a stapler or other type of device used to fasten the canvas to the adjacent edge of the frame.

The canvas stretching operation usually takes place in four parts. First one edge is fastened to the frame and the opposite edge is stretched by means of the present apparatus. Thereafter, the apparatus is used to stretch a third edge of the canvas but by rotation of less than 90° so less than tearing tension is established. This tension is resisted, of course, by the two already fastened edges so that the tendency to bias the canvas toward the third edge is restrained by the two adjacent sides. Thereafter, the fourth edge of the canvas is stretched like the second edge which straightens the previously biased canvas prior to its fastening to the fourth edge. It is preferable when fastening an edge that more area is restrained by staples or nails than when the canvas is being stretched by the pins. Therefore all tearing occurs about the pins which are positioned below the lower surface of the frame. This causes the tears the pins generate to be positioned mostly in the lose canvas edges later trimmed off the frame.

It is therefore an object of the present invention to provide a simple, easily constructed, canvas stretching apparatus which can be made from readily available components.

Another object of the present invention is to provide an apparatus to stretch and mount canvas which does not rely upon frictional engagement between the canvas and some sort of clamping device.

Another object is to provide a canvas stretching device and method which can be used with various gauges of canvas on various size frames without need for recalibration.

Another object is to provide a method for stetching canvas on a frame which requires little skill to accomplish.

These and other objects and advantages of the present invention will become apparent to those skilled in the art after considering the following detailed specification together with the accompanying drawings wherein:

BRIEF DESCRIPTION OF THE DRAWINGS

FIG. 1 is perspective view of an apparatus constructed according to the present invention for stretching canvas;

FIG. 3 is a backside view of a frame with canvas applied,to one edge thereof;

FIG. 8 is a backside view of the frame of FIG. 3 having stretched canvas connected to three edges and the fourth edge being prepared for stretching;

FIG. 9 is an edge view of FIG. 8 taken at line 9—9; and

FIG. 10 is an enlarged perspective view of the corner of the frame of FIGS. 3, 8, and 9 once the stretching operation has been completed.

DETAILED DESCRIPTION OF THE PRESENT INVENTION

Figure 2:
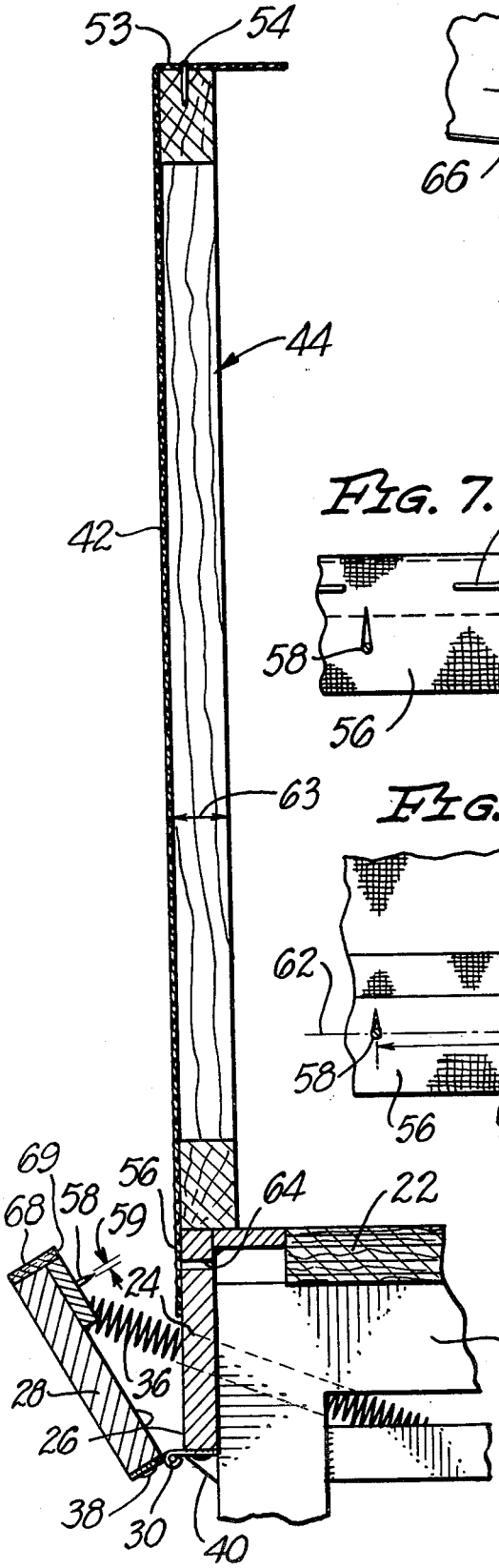
FIG. 2 is an enlarged side view of the jaw portion of the present apparatus about to engage a canvas for stretching about a frame.

Referring to the drawings more particularly by reference numbers, number 20 in FIG. 1 refers to a canvas stretching apparatus constructed according to the present invention. The apparatus 20 includes a tabletop 22 having a flush edge 24 which forms one element of a mating pair of jaws 26 having a jaw member 28 pivotally connected by means of a hinge 30, as shown in FIG. 2. The jaws 26 includes suitable means for opening and closing such as the pneumatic cylinder 32 controlled by a foot treadle 34 connected between the table 35 and the jaw member 28, shown in FIG. 1, or merely a handle, not shown, connected to the jaw member 28 which can be used to move the member 28 over center with respect to a biasing spring 36. The bottom surface 38 of the jaw 28 engages a stop 40 on the table edge 24 in that case to limit open rotation while closing rotation is limited by operative engagement of the jaw member 28 with the edge 24.

When it is desired to use the apparatus 20 to stretch canvas 42 on a frame 44 with sides 46, 48, 50 and 52, the canvas 42 is fastened at a first edge 53, such as by staples 54, to one side 46 of the frame 44, as shown in FIGS. 2 and 3. Thereafter, the edge 56 of the canvas 42 which extends beyond the opposite side 48 of the frame is placed between the edge 24 and the jaw member 28.

Figure 4:
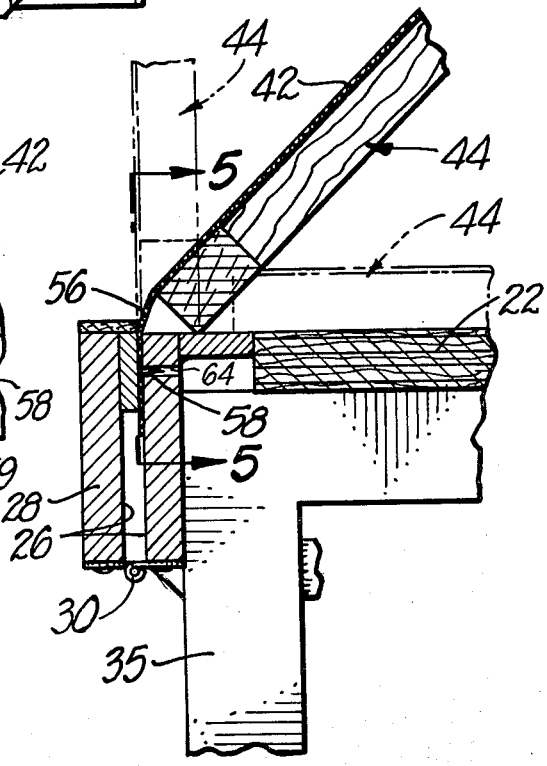
FIG. 4 is a, side view similar to FIG. 3 showing the frame partway through a stretching operation.

The jaw member 28 includes a plurality of sharpened pins 58 having a predetermined diameter 59 and predetermined lateral spacing 60 along a lateral line 62 of the jaw member 28 a distance below the top 22 about the width 63 of the thickest frame to be used. The pins 58 pass through the canvas edge 56 and into orifices 64 in the edge 24 provided for that purpose so that the canvas edge 56 is mechanically engaged by the pins 58. This all occurs with the frame 44 positioned as shown in FIG. 2 at right angles to the tabletop 22. As shown in FIG. 4, the frame 44 then is rotated toward the tabletop 22 stretching the canvas 42 until a predetermined stress which is determined by the diameter 59 of the pins 58, the gauge of the canvas 42 and the spacing 60 of the pins 58 is obtained. At that point, the canvas edge 56 begins to tear around the pins 58 so that no further stretching can occur. It has been discovered that with most normal artists' canvas, the pins should have a diameter 59 from 0.07 inches to 0.15 inches and the spacing 60 thereof should be from 1 inch to 2½ inches. The preferred diameter 59 is 0.10 inches and the preferred spacing 60 is 1½ inches. The woof and the warp of the canvas 42 also should be aligned with the sides 46, 48, 50, and 52 of the frame.

Figure 6:
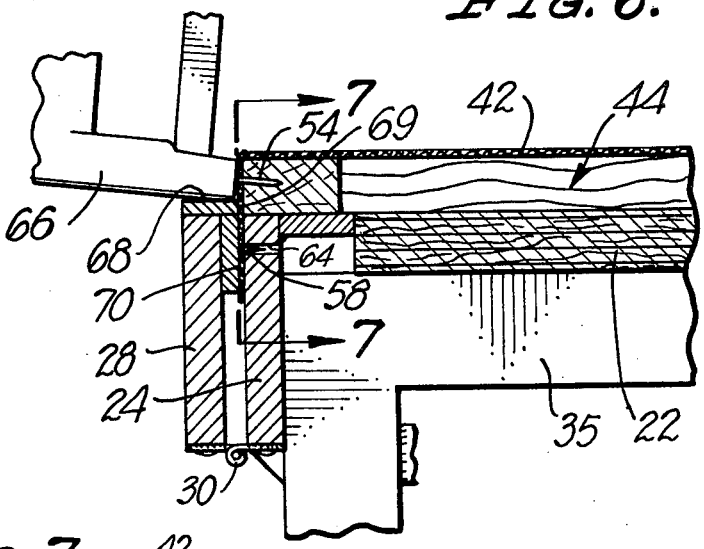
FIG. 6 is a view similar to FIGS. 2 and 4 showing the completion of the attachment of the canvas to the frame during the stretching operation.
Figure 7:
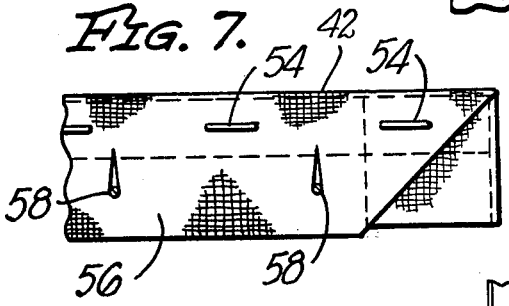
FIG. 7 is view taken on line 7—7 of FIG. 6 at the completion of the stretching operation.
Figure 5:
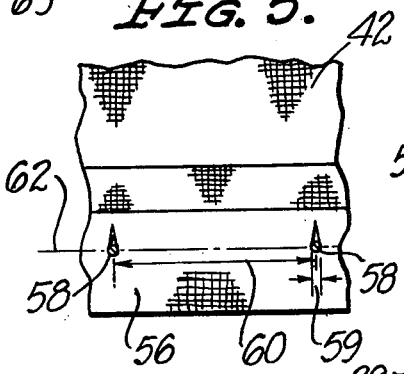
FIG. 5 is a view taken at line 5—5 in Figure 4 during the stretching operation.

Once the frame 44 has rotated parallel to and in contact with the tabletop 22, suitable means such a staple gun 66 are used to drive the staples 54 through the stretched edge 56, as shown in FIG. 6. It is preferable that the top surface 68 of the jaw member 28 is positioned above the tabletop 22 when in the closed position. This forms a flange surface 69 against which the frame 44 can be positively located. The top 68 also can be used to support the staple gun 66 in a properly elevated position for locating the vertical position of the staples 54 with respect to the adjacent side of the frame 44. As shown in FIG. 7, the staples 54 are positioned to provide more contact area than the pins 58 so that no further tearing occurs. At this point, the canvas 42 has been stretched between sides 46 and 48. Thereafter, any canvas 42 beneath the frame 44 is trimmed away. The loose canvas 72 and 74 of the edges 53 and 56 which extend beyond the corners 76 and 78 between sides 48 and 50, and 46 and 50 are folded against the adjacent side 50 which results in a trapezoidal remaining edge 80 of the canvas 42. This edge 80 is engaged with the pins 58 when the frame 44 is in about the 45° position and the frame 44 is rotated into contact with the tabletop 22. This results in less than tearing stress across the center 82 of the canvas 42 where the canvas 42 can move toward the frame side 50 and little stress along the sides 84 and 86 where the folded canvas 88 and 90 prevents engagement with the pins 58.

The fourth edge 92 is then folded as shown in FIGS. 8 and 9 in the same manner so that its shape becomes trapezoidal with triangular corners 94 and 96. The edge 92 is engaged with the pins 58 with the frame 44 in the vertical position and stretched like edge 56, with the corners 94 and 96 relieving the stress along the sides 84 and 86 where no substantial stretching is possible due to the fastened edges 53 and 56.

Since the pins 58 determine the actual stress applied to the canvas 42, no particular skill is required to use the apparatus 20 and frames 44 can have canvas 42 stretched thereabout very quickly by unskilled labor.

Thus there has been shown and described a novel canvas stretching apparatus and method which fulfill all of the objects and advantages sought therefore. Many changes, modifications, variations and other uses and applications of the subject apparatus and method will become apparent to those skilled in the art after considering this specification and the accompanying drawings and claims. All such changes, modifications, variations and other uses and applications which do not depart from the spirit and scope of the invention are deemed to be covered by the invention which is limited only by the claims which follow.

What is claimed is:

1. An apparatus which stretches canvas for attachment to the edges of a frame including:

a frame support surface;

a plurality of sharpened canvas engagement pins;

a canvas engagement surface at generally a right angle to said frame support surface, said canvas engagement surface having:

pin receiving means into which said plurality of sharpened canvas engagement pins can be moved; and means for movably supporting said plurality of sharpened canvas engagement pins with predetermined spacing having:

a jaw member hingedly connected for operative engagement with said canvas engagement surface, said jaw member having:

open and closed positions, said plurality of sharpened canvas engagement pins being positioned on said jaw member to extend into said pin receiving means of said canvas engagement surface when said jaw member is in said closed position and outside of said pin receiving means when said jaw member is in said open position;

a jaw surface positioned for opposition by said canvas engagement surface when said jaw member is in said closed position, when said jaw member is in said closed position said jaw surface extending from said plurality of sharpened canvas engagement pins to beyond said frame support surface to form a frame positioning flange; and a guide surface generally parallel to said frame support surface and on the opposite side thereof from said plurality of sharpened canvas engagement pins.

2. The apparatus defined in claim 1 wherein said means for movably supporting said plurality of sharpened canvas engagement pins with predetermined spacing position said plurality of sharpened canvas engagement pins in a line and include:

bias means connected to said jaw member to urge said jaw member into said closed position.

3. A method for attaching canvas in a stretched condition to a frame having first, second, third, and fourth sides including the steps of:

fastening a first edge of the canvas to the first side of the frame;

engaging a second opposite edge of the canvas to a plurality of pins having a predetermined spacing and a predetermined diameter with the canvas and frame generally at a right angle to and restrained a predetermined distance from the pins;

rotating the frame generally parallel to the pins so that the canvas is stretched by the pins and torn thereabout to establish tension in the canvas between the first and second sides;

fastening the second opposite edge of the canvas to the second side to maintain the tension of the canvas between the first and second sides;

engaging a third edge of the canvas between the first and second sides to a plurality of pins having a predetermined spacing and a predetermined diameter with the canvas and frame at less than a right angle to and restrained a predetermined distance from the pins;

rotating the frame generally parallel to the pins so that the canvas is stretched by the pins to establish a preload tension in the canvas toward the third side;

fastening the third edge of the canvas to the third side to maintain the preload tension of the canvas;

engaging a fourth opposite edge of the canvas to a plurality of pins having a predetermined spacing and a predetermined diameter with the canvas and frame generally at a right angle to and restrained a predetermined distance from the pins;

rotating the frame generally parallel to the pins so that the canvas is stretched by the pins and torn thereabout to establish tension in the canvas between the third and fourth sides; and fastening the fourth edge of the canvas to the fourth side to maintain the tension of the canvas between the third and fourth sides.

4. The method as defined in claim 3 wherein said step of engaging a third edge of the canvas between the first and second sides to a plurality of pins having a predetermined spacing and a predetermined diameter with the canvas and frame at less than a right angle to and restrained a predetermined distance from the pins includes the substep of:

folding the third edge into a trapezoidal shape prior to engagement with the pins so that the corners of the third edge are not engaged thereby.

5. The method as defined in claim 4 wherein said step of engaging a fourth edge of the canvas between the first and second sides to a plurality of pins having a predetermined spacing and a predetermined diameter with the canvas and frame at less than a right angle to and restrained a predetermined distance from the pins includes the substep of:

folding the fourth edge into a trapezoidal shape prior to engagement with the pins so that the corners of the fourth edge are not engaged thereby.

6. The method as defined in claim 5 including before the step of fastening a first edge of the canvas to the first side of the frame the additional step of:

orienting the woof and the warp of the canvas generally with the sides of the frame.

* * * * *